US006666223B2

(12) United States Patent
Price et al.

(10) Patent No.: US 6,666,223 B2
(45) Date of Patent: Dec. 23, 2003

(54) COLLAPSIBLE FRAME

(76) Inventors: Walter L. Price, 1229 E. Gary Cir., Mesa, AZ (US) 85203; Roy Justin Price, 1151 S. Bridger Dr., Chandler, AZ (US) 85249

( * ) Notice: Subject to any disclaimer, the term of this patent is extended or adjusted under 35 U.S.C. 154(b) by 0 days.

(21) Appl. No.: 09/929,698

(22) Filed: Aug. 13, 2001

(65) Prior Publication Data

US 2003/0029490 A1 Feb. 13, 2003

(51) Int. Cl.[7] ..... E04H 15/38; E04H 15/50

(52) U.S. Cl. ..... 135/131; 135/145; 135/146; 135/147; 135/159; 135/114

(58) Field of Search ..... 135/130, 131, 135/145, 146, 147, 157, 158, 159, 160, 114

(56) References Cited

U.S. PATENT DOCUMENTS

| | | | | | |
|---|---|---|---|---|---|
| 957,215 | A | | 5/1910 | Juin | |
| 2,137,625 | A | | 11/1938 | Norvell | |
| 2,723,673 | A | | 11/1955 | Call | |
| 2,962,034 | A | | 11/1960 | Finlayson | |
| 3,266,503 | A | | 8/1966 | Hoiness et al. | |
| 3,810,482 | A | | 5/1974 | Beavers | |
| 4,066,089 | A | | 1/1978 | Rainwater | |
| 4,074,682 | A | | 2/1978 | Yoon | |
| 4,285,354 | A | | 8/1981 | Beavers | |
| 4,558,713 | A | | 12/1985 | Hagler et al. | |
| 4,779,635 | A | * | 10/1988 | Lynch | 135/97 |
| 4,947,884 | A | | 8/1990 | Lynch | |
| 5,224,507 | A | | 7/1993 | Vosse | |
| 5,511,572 | A | | 4/1996 | Carter | |
| 5,577,799 | A | | 11/1996 | St. Germain | |
| 5,632,293 | A | | 5/1997 | Carter | |
| 5,634,483 | A | | 6/1997 | Gwin | |
| 5,638,853 | A | | 6/1997 | Tsai | |
| 5,701,923 | A | * | 12/1997 | Losi et al. | 135/131 |
| 5,806,549 | A | | 9/1998 | Love | |
| 5,944,040 | A | * | 8/1999 | Jang | 135/126 |
| 6,089,247 | A | * | 7/2000 | Price | 135/145 |
| 6,216,717 | B1 | * | 4/2001 | Chen | 135/130 |
| 6,374,843 | B1 | * | 4/2002 | Zou | 135/145 |
| 6,382,224 | B1 | * | 5/2002 | Carter | 135/145 |
| 6,470,902 | B1 | * | 10/2002 | Carter | 135/145 |
| 2001/0025648 | A1 | * | 10/2001 | Carter | 135/145 |
| 2002/0059948 | A1 | * | 5/2002 | Carter | 135/121 |
| 2002/0104561 | A1 | * | 8/2002 | Carter | 135/145 |

* cited by examiner

*Primary Examiner*—Robert Canfield
(74) *Attorney, Agent, or Firm*—Lewis, Brisbois, Bisgaard & Smith LLP

(57) ABSTRACT

A collapsible frame for use in erecting tents, canopies and the like at outdoor venues includes a plurality of telescopic legs for providing vertical structural support, and a plurality of top corner joints each fixedly mounted upon a top end of a corresponding telescopic leg. A leg slider joint is adjustably mounted upon each telescopic leg for sliding along that telescopic leg. A truss pair of link members is mounted to a pair of top corner joints and to a corresponding pair of leg slider joints mounted on adjacent pairs of telescopic legs for providing a scissors connector. Finally, a plurality of canopy support arms each including a flexible connector, and each fixedly connected to a top corner joint and a corresponding leg slider joint, is employed for raising and lowering the collapsible frame as a stable unitary structure.

19 Claims, 12 Drawing Sheets

COLLAPSIBLE FRAME

BACKGROUND OF THE INVENTION

1. Technical Field

The present invention relates to the assembly and disassembly of temporary structures and other protective shelters typically in the out-of-doors. More specifically, the present invention relates to methods and apparatus for a collapsible frame of unitary structure for use in erecting tents, insect screen rooms, shade awnings, canopies and the like at campsites, back yard patios and other outdoor venues.

2. Background Art

The relevant art is directed to collapsible frames utilized in erecting temporary structures for use in the out-of-doors. The typical frame apparatus of the prior art is employed in combination with, for example, a canopy as a temporary shelter, or as a frame for a tent to serve various functions in the outdoors.

The outdoor venue in which the frame apparatus of the prior art is typically utilized varies widely. The outdoor venue can be a campsite for hunting, fishing, hiking, rock climbing, a roadside camping facility for recreational vehicles, an outdoor market where goods are offered for sale or any other outdoor activity typically removed from ones residence. In the alternative, the outdoor venue can be as local as a barbecue grill located at a city park, the beach or even on the patio or in the back yard of ones own residence.

Many of the collapsible frames of the prior art involve complicated articulated linkage which is difficult to manipulate. Additionally, it is typical for the upper support structure of the frame to be completely removed from the support legs during disassemble and then re-mounted on the support legs during assembly of the frame. This design results in a flimsy, unstable frame because it lacks unitary structure. Also, many of the prior art frames are heavy and cumbersome to assemble and disassemble and thus are neither convenient nor desirable choices by persons of small physical stature. Another common problem relates to the frequent misplacing or loss of some of the plurality of component parts necessary for the assembly of the frame. As a result, certain components necessary to complete assembly of the frame may not be available and thus the effort to complete assembly of the frame is frustrated.

Examples of the prior art include a frame apparatus employed as a collapsible shelter which includes a flexible collapsible canopy. The collapsible shelter includes a truss and canopy framework that enables the flexible, collapsible canopy to be moved between a raised position and a lowered position. The shelter includes at least three legs supporting flexible poles removably mounted to the tops of the legs and forming the framework of the canopy. X-shaped truss pairs of link members (known in the art as a scissors construction) are connected to each of the legs on each side of the shelter between adjacent legs. The scissors construction exhibits an articulated frame linkage of which the components must be accurately sized in order for the collapsible feature to be realized.

Another example of a frame apparatus includes a tent structure which exhibits an elevated tent framework having a plurality of support legs and elevated rafters for supporting a tent canvas useful, for example, at a burial site. Yet another example is a framework having non-adjustable support legs driven into the ground for stability. Another example of a frame apparatus is disclosed in a geodesic dome shelter where the construction skeleton radiates outwardly from the apex portion of the shelter. Another example is a framework in which the skeleton provides a rectangular cage on which a canvas top is suspended. The framework is collapsible but each component of the cage must be manually disassembled.

A canopy support system is also known in the prior art which is intended to support the canopy portion of a self-contained collapsible canopy type tent. The support system includes a plurality of interconnected resilient cord elements extending from a central hub to multiple support frame attachment points around a collapsible metal frame of the tent. The resilient cords are adjustable for providing the required tension and provide intermediate canopy support between a central support pole and a perimeter support frame. Another example of a frame apparatus teaches a tent structure which includes four poles interconnected by four scissors-type linkages forming a square structure and four intermediate pivot connecting members.

Many other frame apparatuses are known in the prior art for providing an enclosure or canopy arrangement for the purpose of, for example, enclosing a utility manhole in the street or enclosing a public utilities crew in a work environment. Although these frame apparatuses are collapsible and lightweight, many lack the structural integrity necessary to endure continuous usage and the elements. Because the upper support structure of many of these frame apparatuses is not unitary with the lower support legs, these frames known in the prior art lack structural integrity and tend to be flimsy.

Thus, there is a need in the art for a collapsible frame that comprises a lightweight, simplified robust construction fashioned into a rigid frame, in which the telescopic corner legs and the upper support structure including the superstructure are permanently connected to facilitate prompt raising and lowering of the collapsible frame as a unitary structure where the superstructure operates in unison with the remainder of the frame components to provide improved stability to the frame structure, and to minimize misplacing component parts, where the collapsible frame exhibits a means for conveniently adjusting the vertical height thereof, and is easily manipulated by persons of small physical stature.

DISCLOSURE OF THE INVENTION

Briefly, and in general terms, the present invention provides a new and improved collapsible frame for use in erecting tents, insect screen rooms, shade awnings, canopies and the like in the out-of-doors such as campsites, back yard patios and other outdoor venues. The novel and non-obvious collapsible frame exhibits a robust lightweight design including an aluminum frame. The collapsible frame is raised and lowered quickly and easily since each of the component elements remains connected in the collapsed position, i.e., the collapsible frame is a unitary structure. The height of the collapsible frame can be easily adjusted so that the superstructure provides adequate headroom for average height persons. When collapsed, the frame is transported and stored in a convenient carrying enclosure.

The collapsible frame of the present invention includes a plurality of four telescopic corner legs generally forming a rectangular pattern to create an upper support structure. Each telescopic corner leg includes an inner shaft and an outer shaft for adjusting the height thereof. A top corner joint is mounted to the top of each telescopic corner leg and a leg slider joint is positioned for translational motion along each of the corner legs. X-shaped truss pairs of link members (typically known in the art as a scissors connector) are positioned between each adjacent pair of telescopic corner legs for enabling the corner legs to be moved in a scissors fashion.

A superstructure comprised of four canopy support arms is fixedly attached to the upper support structure at the corresponding top corner joint and leg slider joint of each telescopic corner leg. The canopy support arms are connected together at the apex of the collapsible frame by a top joint connector. Each of the canopy support arms includes a flexible connector which can be an elastic connector in combination with a link chain, or a hinge in combination with a sliding sleeve. Each of the telescopic corner legs also includes a base foot for improving the stability of the frame. Finally, a V-shaped, spring-loaded push button is employed for adjusting the height of each of the telescopic legs and for securing the position of the bottom slider. This combination of components enables the collapsible frame to be raised and lowered as a unitary structure.

The present invention is generally directed to a collapsible frame for use in erecting tents, insect screen rooms, shade awnings, canopies and the like in the out-of-doors and typically employed at, for example, campsites, roadside camping facilities for recreational vehicles, city parks, the seashore or even on the patio or in the back yard of a residence or other outdoor venue. In its most fundamental embodiment, the collapsible frame comprises a plurality of telescopic legs for providing vertical structural support and a plurality of top corner joints with each corner joint fixedly mounted upon a top end of a corresponding one of the telescopic legs. A leg slider joint is adjustably mounted upon each of the telescopic legs for sliding along a corresponding one of the telescopic legs. A truss pair of link members is mounted to a pair of the top corner joints and to a corresponding pair of the leg slider joints mounted on each adjacent pair of telescopic legs for providing a scissors connector. Finally, a plurality of canopy support arms each including a flexible connector, and each fixedly connected to a corresponding one of the top corner joints and to a corresponding one of the leg slider joints, is employed for raising and lowering the collapsible frame as a stable unitary structure.

These and other objects and advantages of the present invention will become apparent from the following more detailed description, taken in conjunction with the accompanying drawings which illustrate the invention, by way of example.

DESCRIPTION OF THE PREFERRED EMBODIMENTS

Figure 1:
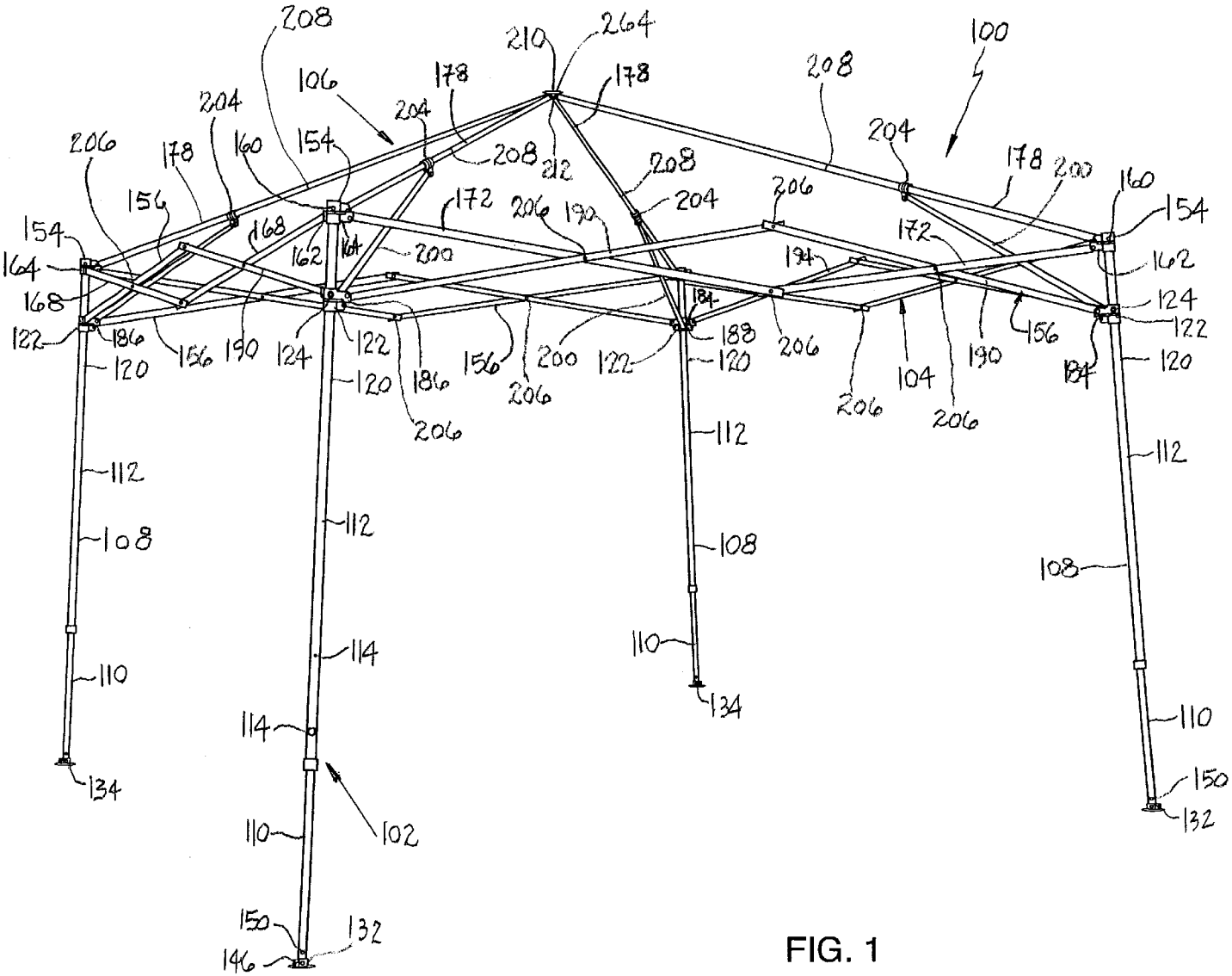
FIG. 1 is a perspective view of a collapsible frame of the present invention showing four telescopic corner legs fully extended and supporting an upper support structure comprising a rectangular frame having four top corner joints, four leg slider joints and four X-shaped truss pairs of link members employed to support a cooperating superstructure which intersects at a center joint.

The present invention is a collapsible frame 100 as best shown in FIG. 1 for use in erecting tents, insect screen rooms, shade awnings, canopies and the like typically in the out-of-doors. The collapsible frame 100 of the present invention serves as a support by providing a structure for attaching material components such as canvas, netting, screens, plastic and the like for erecting tents, screen rooms, awnings and canopies as desired. The collapsible frame 100 is typically employed at campsites, roadside camping facilities for recreational vehicles, city parks, the seashore or even on the patio or in the back yard of a residence or other outdoor venue.

A preferred embodiment of the collapsible frame 100 is shown in FIGS. 1–4 and 7–22 and comprises three main categories which include a base portion 102, an upper support structure 104 and a superstructure 106. A description of the main components of each of these three main categories will now be set out in successive order.

Figure 2:
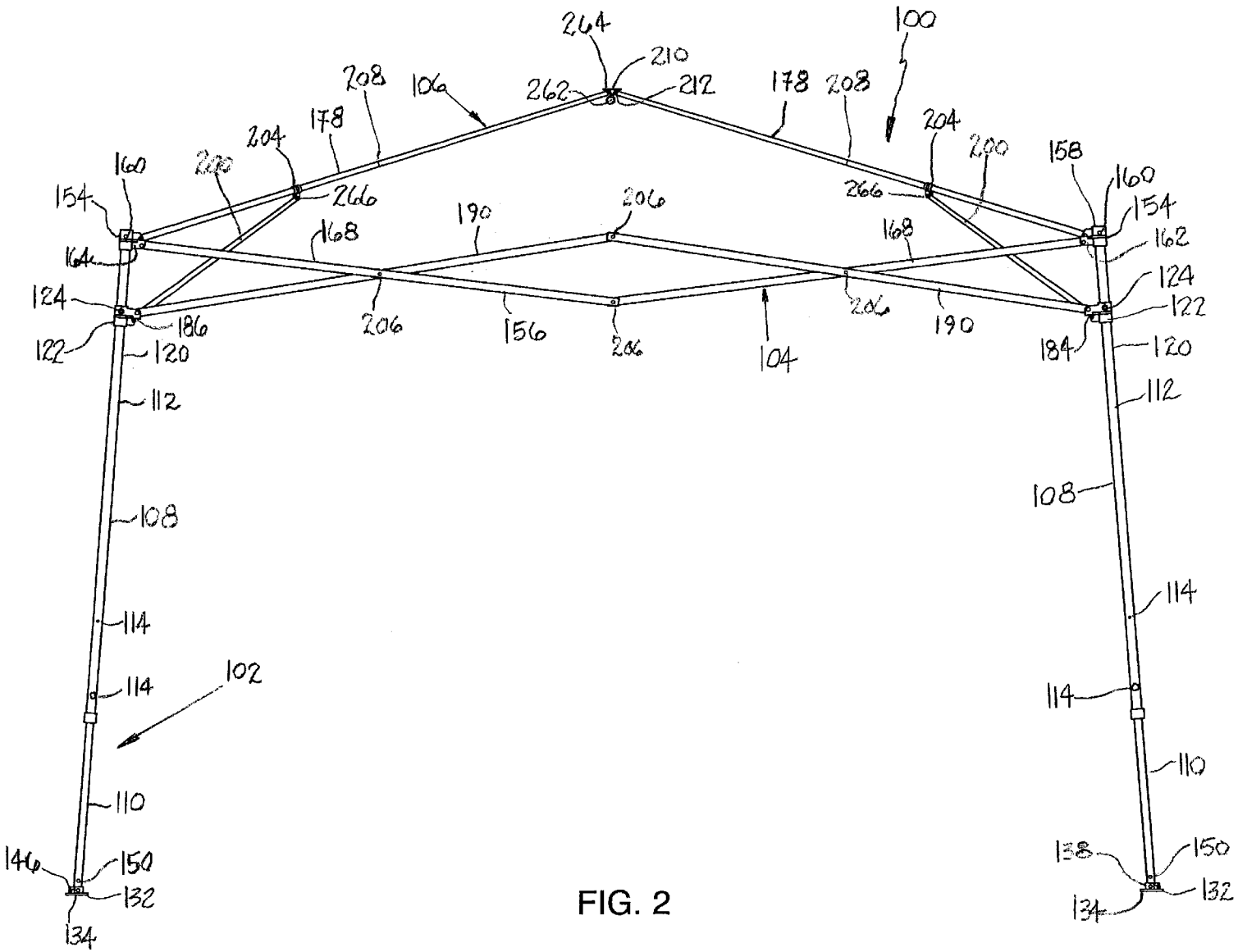
FIG. 2 is a side elevation of the collapsible frame of FIG. 1 showing the relationship between the telescopic corner legs, four top corner joints, corresponding leg slider joints, X-shaped truss pairs of link members, and the cooperating superstructure comprised of four canopy support arms and angular support arms shown fully extended.
Figure 7:
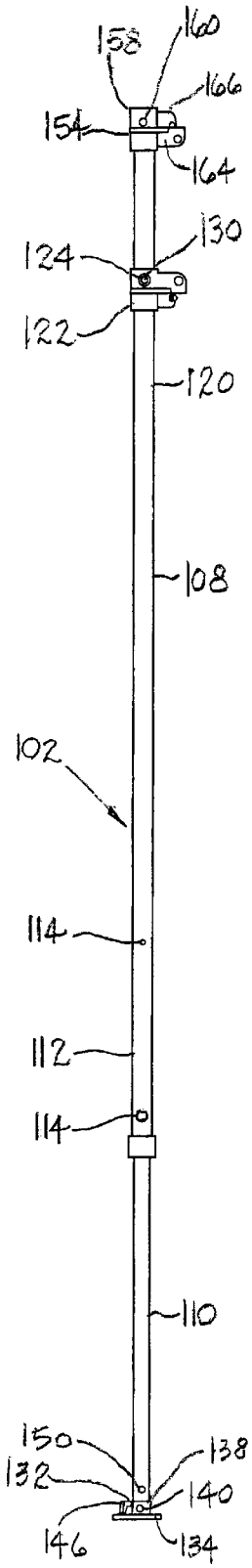
FIG. 7 is a front elevation of one of the four telescopic corner legs of the collapsible frame of FIG. 1 shown in the fully extended position.
Figure 8:
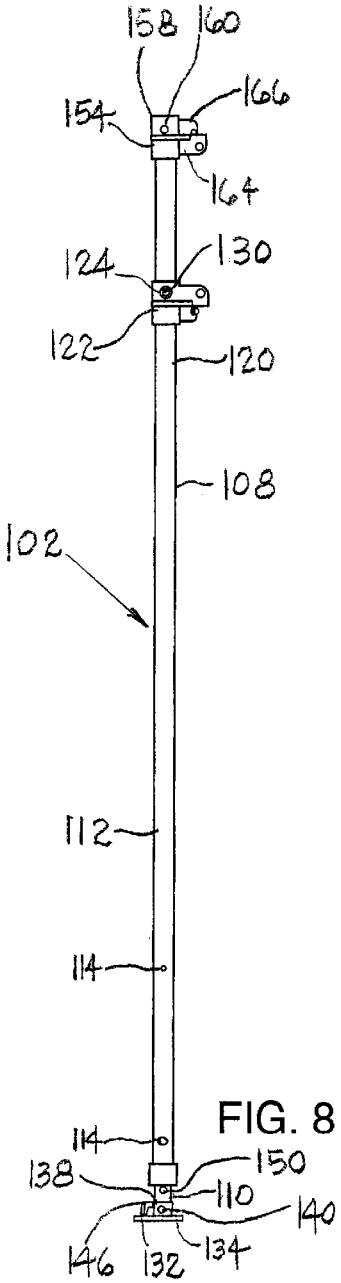
FIG. 8 is a front elevation of the telescopic corner leg of FIG. 7 shown in the fully retracted position.
Figure 9:
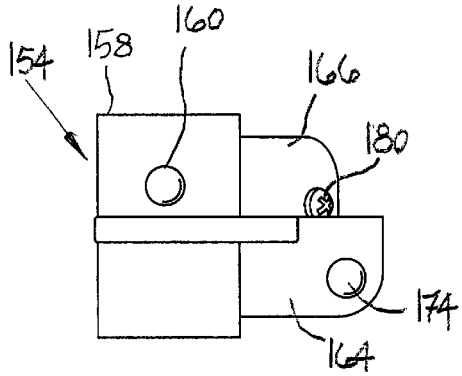
FIG. 9 is a side elevation of one of the four top corner joints of the collapsible frame of FIG. 1.

The base portion 102 includes a plurality of four telescopic corner legs 108 each having an inner shaft portion 110 and an outer shaft portion 112 as is shown in FIGS. 1 and 2. The inner shaft portion 110 telescopes upward into the interior of the outer shaft portion 112 of the telescopic legs 108 as is best shown in FIGS. 7 and 8. Thus, both the inner shaft portion 110 and the outer shaft portion 112 (and other components described hereinafter) adopt an aluminum square-shaped configuration as is shown in FIGS. 1 and 2. It has been discovered that the square-shaped configuration glides easier and fits more securely for providing the collapsible frame 100 with a more stable structure.

Figures 3, 4, 5, 6:
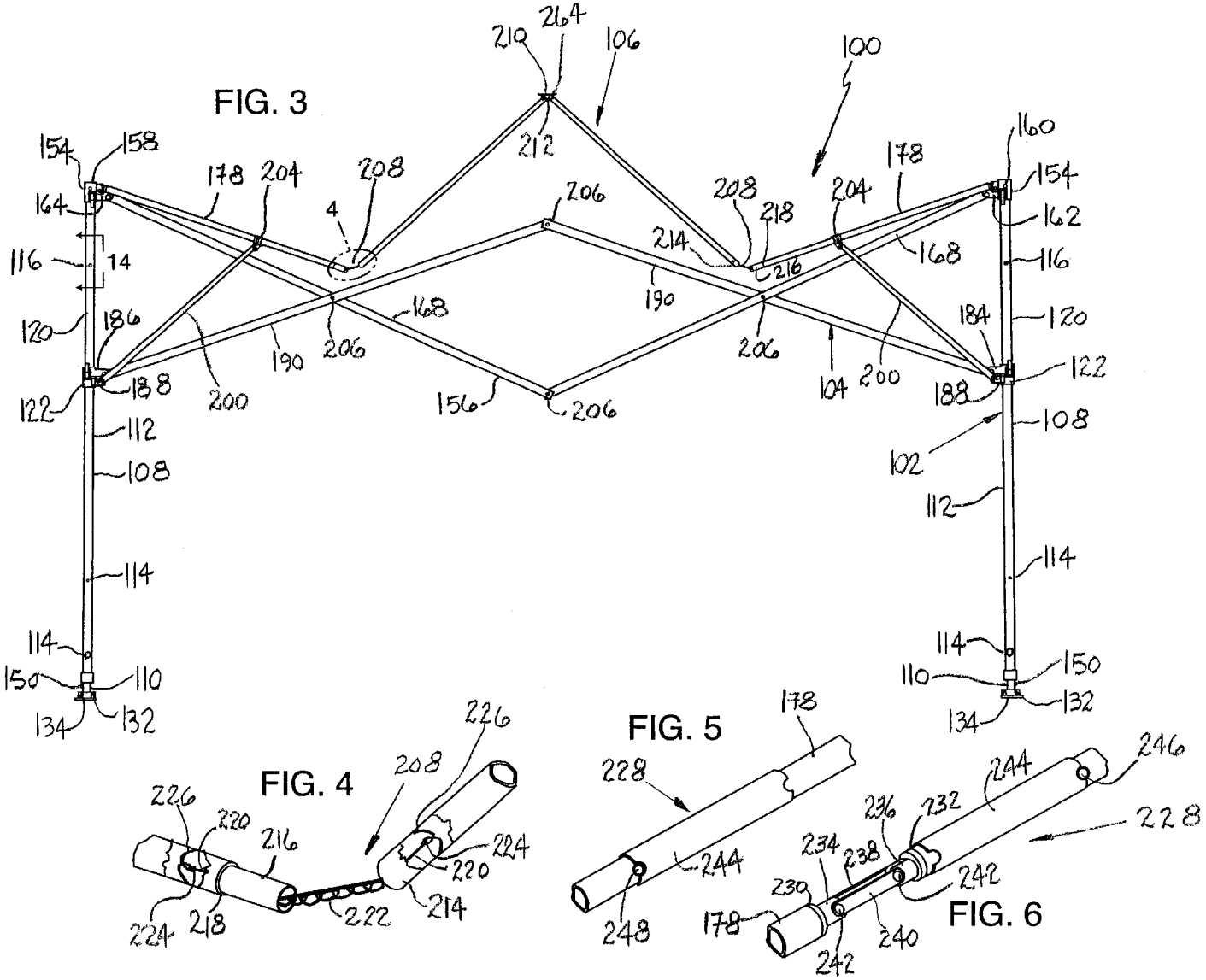
FIG. 3 is another side elevation of the collapsible frame of FIG. 1 (opposite to the view appearing in FIG. 2) showing the canopy support arms partially collapsed at a flexible connector, and further showing the telescopic corner legs, top corner joints, leg slider joints, X-shaped truss pairs of link members, and the angular support arms.
FIG. 4 is an exploded view of the flexible connector of each of the canopy support arms of the collapsible frame of FIG. 1 shown with the components of the flexible connector attached with a elastic cord.
FIG. 5 is an alternative flexible connector employed with each of the canopy support arms of the collapsible frame of FIG. 1 showing a movable sleeve in the engaged position surrounding the two terminal ends of one of the four canopy support arms to facilitate structural integrity of the frame.
FIG. 6 is another view of the alternative flexible connector employed with each of the canopy support arms as shown in FIG. 5 showing the movable sleeve in the disengaged position for exposing a hinge as the flexible connector.

The outer shaft portion 112 of each telescopic corner leg 108 includes two penetrations 114 and a third penetration 116 formed therein. The first two penetrations 114 formed in each outer shaft portion 112 are clearly shown in FIGS. 1–3 and 7–8 while the third penetration 116 is best shown in FIG. 3. One of the penetrations 114 formed in each outer shaft portion 112 is selected to be aligned with a corresponding one of a plurality of V-shaped, spring-loaded pushbuttons 118. The corresponding pushbutton 118 is mounted within the inner shaft portion 110 of the corresponding telescopic corner leg 108. The pushbutton 118 extends through a penetration (not shown) in the inner shaft portion 110. When the penetration (not shown) formed in the inner shaft portion 110 is aligned with the selected penetration 114 formed in the outer shaft portion 112, the pushbutton 118 can extend there through. In this manner, the length of the telescopic corner leg 108 (and thus the overall height of the collapsible frame 100) can be adjusted. Either of the two penetrations 114 can be selected (consistent with each telescopic corner leg 108) for selecting the desired height of the collapsible frame 100. It is to be understood that the number of penetrations 114 formed in the outer shaft portion 112 can vary and thus is not limited to any specific number.

Likewise, the third penetration 116 formed within the outer shaft portion 112 serves to provide a port through which a second of the plurality of V-shaped, spring-loaded pushbuttons 118 extends through. The third penetration 116 is formed through an upper section 120 of each of the telescopic corner legs 108 for interfacing with a leg slider joint 122 mounted on each telescopic corner leg 108. The leg slider joint 122, which is shown in FIGS. 1–3 and 7–8 and in FIG. 12, includes a penetration 124 formed there through. The penetration 124 in the leg slider joint 122 is formed in the same plane as the penetration 116 in the outer shaft portion 112. Thus, when the leg slider joint 122 of each telescopic corner leg 108 is positioned by sliding over the third penetration 116, the V-shaped, spring-loaded pushbutton 118 pops through the penetration 124 formed in the leg slider joint 122 to lock the leg slider joint 122 in position. This situation is shown clearly in FIG. 1. However, when the pushbutton 118 is depressed, the slider joint 122 is free to travel downward along the telescopic corner leg 108. This situation is shown in FIG. 3.

The construction of the V-shaped, spring-loaded pushbutton 118 which is comprised of metal is employed for locking a first component part to a second component part in the collapsible frame 100 in two separate applications. In the first application, the V-shaped, spring-loaded pushbutton 118 is employed for locking the leg slider joint 122 to the outer shaft portion 112 of the telescopic corner leg 108 as is shown in FIGS. 1, 2 and 7. In the second application, the V-shaped, spring-loaded pushbutton 118 is employed for locking the outer shaft portion 112 to the inner shaft portion 110 for adjusting the length of the telescopic corner legs 108 as shown in FIGS. 1–3 and 7–8. In both applications, the V-shaped, spring-loaded pushbutton 118 serves the same function in the same manner. Thus, the discussion of the V-shaped, spring-loaded pushbutton 118 and the illustration shown in FIG. 14 will be directed to the application in which the pushbutton 118 is employed for locking the leg slider joint 122 to the outer shaft portion 112. The description of the structural components and operation applies equally to the application of locking the outer shaft portion 112 to the inner shaft portion 110.

Figure 14:
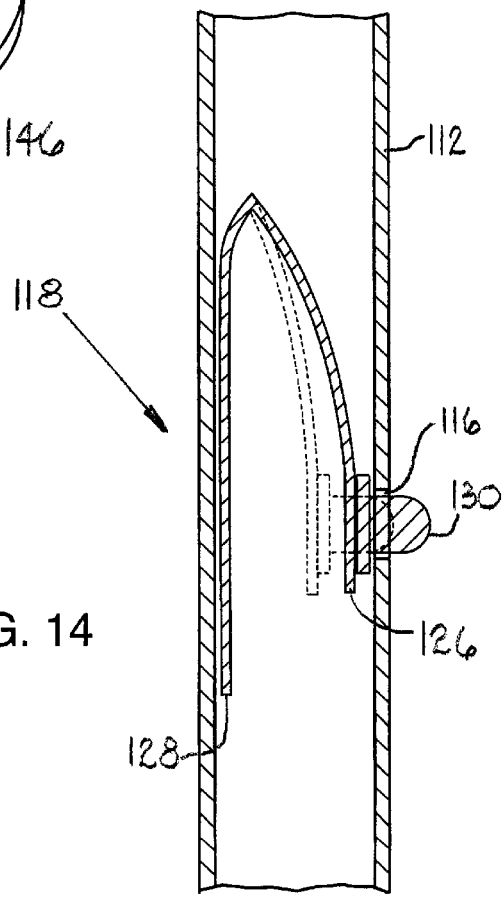
FIG. 14 is a cross-sectional view of a V-shaped, spring-loaded push button for use with the telescopic components of the collapsible frame taken along line 14—14 of FIG. 3 showing the V-shaped configuration.

Referring now to FIG. 14, the spring-loaded pushbutton 118 is V-shaped in configuration and is shown positioned inside the square construction of the outer shaft portion 112 of one of the telescopic corner legs 108. Each of the spring-loaded pushbuttons 118 which can be comprised of aluminum includes a first end 126 and a second end 128 as shown in FIG. 14. The first and second ends 126 and 128, respectively, apply force to the inside surface of the square-shaped outer shaft portion 112 by virtue of the spring tension associated with the V-shape of the spring-loaded pushbutton 118. This spring tension associated with the V-shape of the spring-loaded pushbutton 118 causes the pushbutton 118 to remain in position. The side of the V-shaped, spring-loaded pushbutton 118 associated with the first end 126 thereof includes a bump or rise 130 that serves as a button. The bump or rise 130 is shown extending through the outer shaft portion 112 of the telescopic corner leg 108. The bump or rise 130 would then extend through the penetration 124 of the leg slider joint 122 as shown in FIGS. 7 and 8.

During the lowering of the collapsible frame 100, the leg slider joint 122 is released by manually depressing the bump or rise 130 sufficiently far enough to pass the square configuration of the leg slider joint 122 but not the square configuration of the outer shaft portion 112. Under these conditions, the leg slider joint 122 is free to glide over the square confines the outer shaft portion 112. Thereafter, the leg slider joint 122 slides downward on the outer shaft portion 112 and the entire frame 100 can then be collapsed. When the collapsible frame 100 is being raised, the leg slider joint 122 is moved upward on each corresponding outer shaft portion 112 of the telescopic corner leg 108. When the leg slider joint 122 intersects the bump or rise 130 of the pushbutton 118 extending out of penetration 116 of the outer shaft portion 112, the bump or rise 130 is forced downward. However, because of the spring tension in the V-shaped, spring-loaded pushbutton 118, the bump or rise 130 will be forced through the penetration 124 in the leg slider joint 122 when the penetration 124 becomes aligned with the penetration 116 of the telescopic corner leg 108. The leg slider joint 122 is then locked into position with respect to the outer shaft portion 112 and the adjustment is complete. It is noted that this description applies equally to the application of locking the outer shaft portion 112 to the inner shaft portion 110 when adjusting the length of the telescopic corner leg 108.

The plurality of telescopic corner legs 108 may be set at a small angle to a perpendicular vertical. Stated another way, the angle that the top of each telescopic corner leg 108 makes with the upper support structure 104 is slightly greater than a right angle, i.e., an obtuse angle. This construction is best shown in FIG. 1 and causes the base portion 102 of the collapsible frame 100 to be somewhat wider and thus to exhibit greater stability. To further improve the stability of the base portion 102, the bottom of each of the inner shaft portions 110 of each of the telescopic corner legs 108 includes a base foot 132. Each base foot 132 is positioned at a suitable angle and serves to provide greater footing of the base portion 102 thus increasing the stability of the collapsible frame 100.

Figure 13:
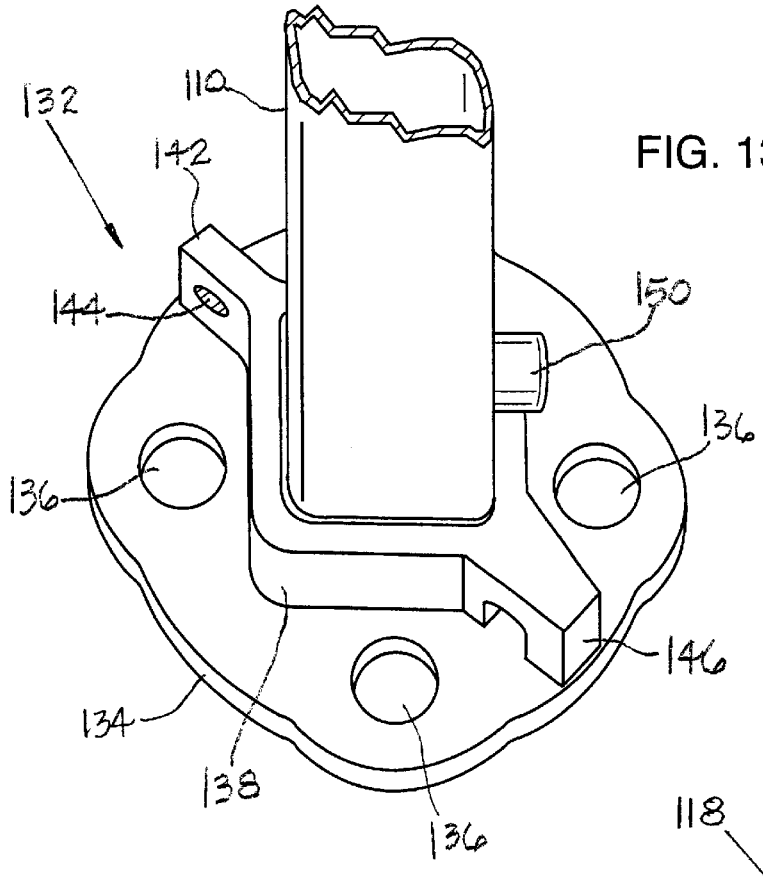
FIG. 13 is an enlarged perspective view of a base foot located at the bottom of each of the four telescopic corner legs of the collapsible frame of FIG. 1 showing a plurality of first penetrations intended for ground stakes, second penetrations for anchoring a canopy cover, and a stop stud for terminating the travel of the outer telescopic leg.

The base foot 132 is clearly shown in FIGS. 1–3, 7–8, 15, and 22 but is shown best in FIG. 13. The base foot 132 shown in enlarged FIG. 13 includes a plastic construction comprising a generally circular flat planar portion 134 that is placed on the ground or floor surface upon which the collapsible frame 100 is erected. The flat planar portion 134 includes a plurality of penetrations 136 (typically four) used for receiving corresponding ground stakes (not shown). The ground stakes (not shown) are driven into the ground through the penetrations 136 for improving the stability of the collapsible frame 100. Molded to the plastic flat planar portion 134 of the base foot 132 is a vertical receiving cup 138 employed for receiving the bottom of the inner shaft portion 110 as shown in FIG. 13. The inner shaft portion 110 is retained within the vertical receiving cup 138 by a fastener 140 best shown in FIGS. 7 and 8. The vertical receiving cup 138 also includes a first extension 142 having a penetration 144 formed therein and a second extension 146 formed in the shape of a hook, i.e., a hook extension 146. The first extension 142 and corresponding penetration 144, and the second (hook) extension 146 formed on the vertical receiving cup 138 of the base foot 132 are employed for anchoring a canopy 148 described hereinbelow with reference to FIGS. 15–19.

The bottom of each of the inner shaft portions 110 further includes a stop stud 150 extending outwardly, i.e., orthogonal, to the vertical direction of the inner shaft portion 110 of the telescopic corner legs 108. Each of the stop studs 150 serves to limit the downward travel of the outer shaft portion 112 along the inner shaft portion 110. Each stop stud 150 is comprised of aluminum as is most of the collapsible frame 100. The stop stud 150 can be molded or threaded to the inner shaft portion 110 as shown in FIG. 13.

The components of the upper support structure 104 will now be addressed. The upper support structure 104 contributes to the support and collapsibility of the frame 100 and includes the following main components. Mounted upon each of the square-shaped telescopic corner legs 108 is the leg slider joint 122. Mounted at the very top of each of the telescopic corner legs 108 is a top corner joint 154. Extending between each adjacent pair of telescopic corner legs 108 and connected to the corresponding top corner joint 154 and leg slider joint 122 of each adjacent telescopic corner leg 108 is an X-shaped truss pair of link members 156. The X-shaped truss pair of link members 156 is typically known as a scissors connector in the collapsible frame art. Each of these components of the upper support structure 104 operate together as a unitary structure in combination with the base portion 102 and the superstructure 106, and are clearly shown in FIGS. 1–3.

Figure 11:
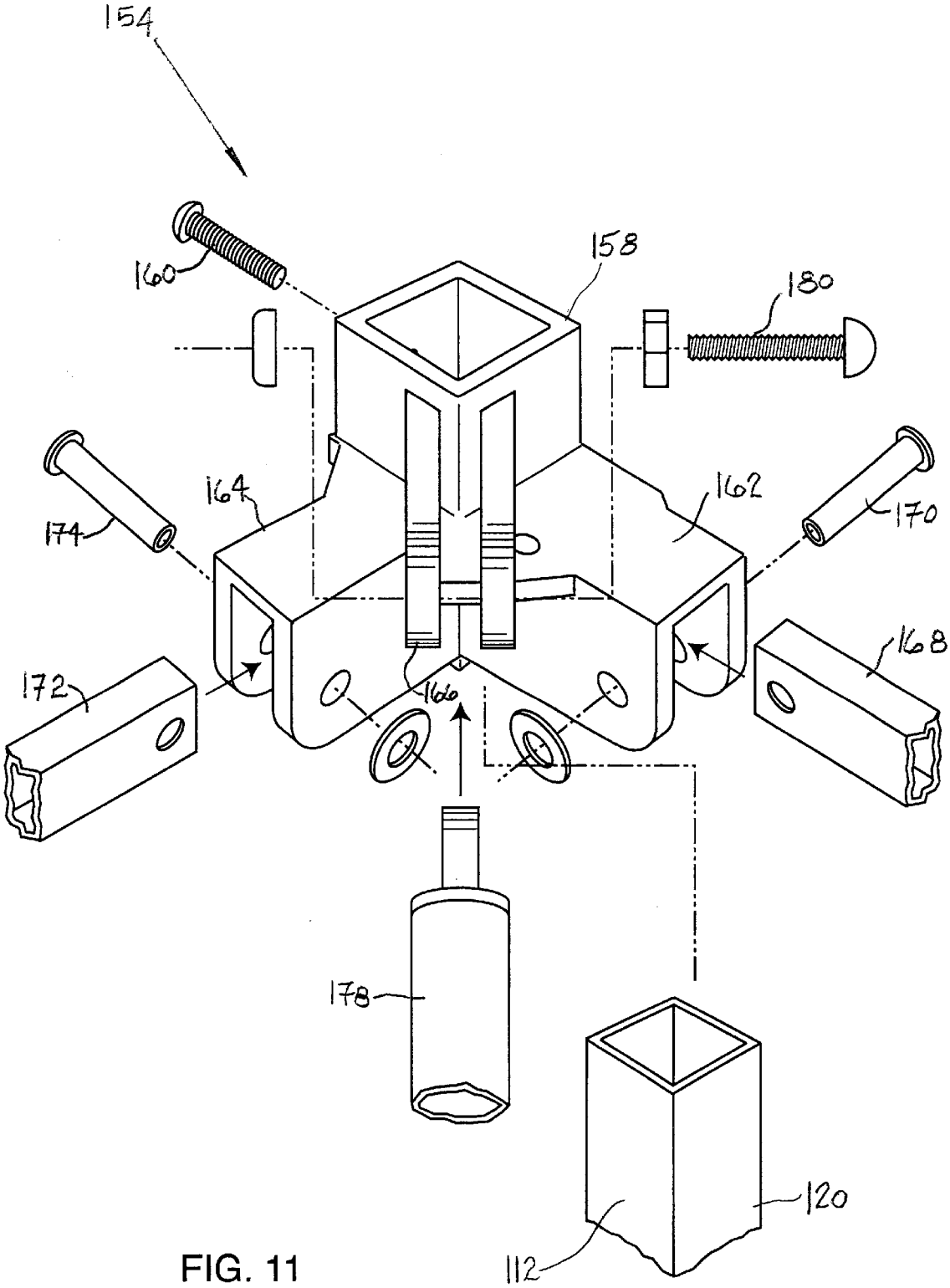
FIG. 11 is a perspective exploded view of one of the four top corner joints of the collapsible frame of FIG. 1 showing the interconnection between each of the top corner joints and the two adjacent X-shaped truss pairs of link members, and also between the top corner joint and one of the four canopy support arms.

Each of the top corner joints 154 is comprised of high strength plastic and is clearly shown in the exploded view of FIG. 11. Each top corner joint 154 includes a main body 158 which is mounted on top of the upper section 120 of the outer shaft portion 112. The main body 158 is attached to the top of the outer shaft portion 112 with a threaded fastener 160 as shown in FIGS. 1–3 but best shown in FIGS. 9 and 11. The main body 158 functions to securely attach each top corner joint 154 to the corresponding outer shaft portion 112 of the telescopic corner leg 108. The top corner joint 154 is designed to cooperate with the X-shaped truss pair of link members 156 and with the superstructure 106. This function is accomplished by a plurality of three brackets molded to the main body 158 of the top corner joint 154.

Each of the top corner joints 154 includes a first bracket 162, a second bracket 164, and a third bracket 166 as is shown in FIG. 11. The first bracket 162 and the second bracket 164 are orthogonal to one another, i.e., generally formed at right angles. The first bracket 162 of the top corner joint 154 is connected to a first of a plurality of link members 168 of the truss pair of link members 156 with a fastener 170 such as, for example, a rivet. The first of the plurality of link members 168 is likewise connected to the second bracket 164 of the top corner joint 154 mounted on the outer shaft portion 112 of the adjacent telescopic corner leg 108 as shown in FIGS. 1–3. The second bracket 164 of the top corner joint 154 shown in FIG. 11 is connected to a first of a plurality of link members 172 of the truss pair of link members 156 with a duplicate fastener 174. The first of the plurality of link members 172 is likewise connected to the first bracket 162 of the top corner joint 154 mounted on the outer shaft portion 112 of the adjacent telescopic corner leg 108 best shown in FIG. 1. Likewise, each first bracket 162 of the top corner joint 154 of a telescopic corner leg 108 is connected to the second bracket 164 of the adjacent top corner joint 154 of the adjacent telescopic corner leg 108. In this manner, each top corner joint 154 of each telescopic corner leg 108 is connected to the adjacent top corner joint 154 of the adjacent telescopic corner leg 108 via a link member of the truss pair of link members 156.

The third bracket 166 is employed to connect each of the top corner joints 154 mounted on the top of each of the telescopic corner legs 108 with the superstructure 106. Thus, each of the third brackets 166 is connected to a corresponding one of a plurality of four canopy support arms 178 via a threaded fastener 180 as shown in FIG. 11. The canopy support arms 178 are also shown in FIGS. 1–3, 20 and 21. The features and operation of the canopy support arms 178 will be described in detail hereinbelow with reference to the superstructure 106.

Figure 12:
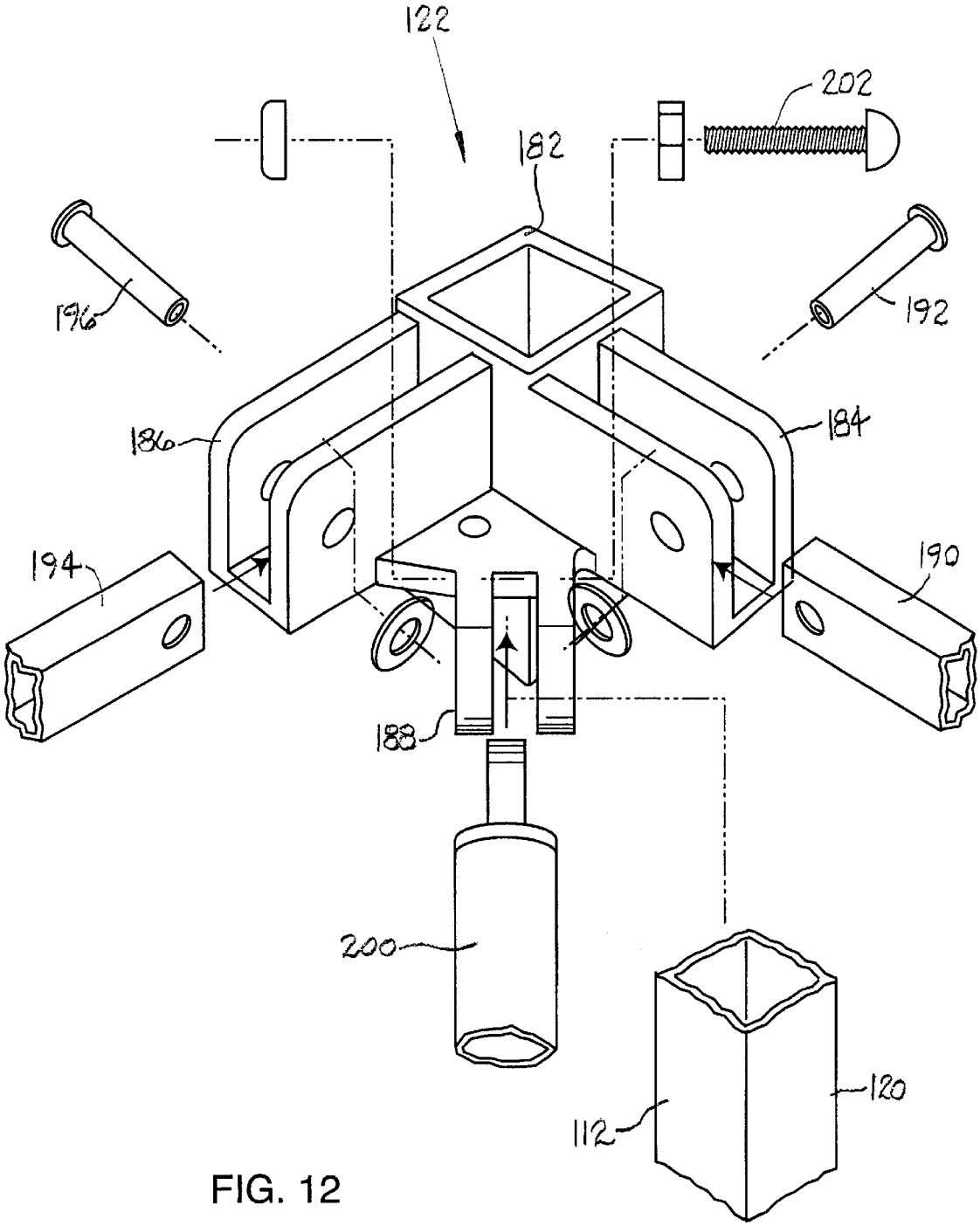
FIG. 12 is a perspective exploded view of one of the four leg slider joints of the collapsible frame of FIG. 1 showing the interconnection between each of the leg slider joints and the two adjacent X-shaped truss pairs of link members, and also between the leg slider joint and one of the four angular support arms.

Each of the leg slider joints 122 is comprised of high strength plastic and is clearly shown in the exploded view of FIG. 12. Each leg slider joint 122 includes a main body 182 which is square-shaped and mounted upon the outer shaft portion 112 of the corresponding telescopic corner leg 108. The main body 182 which is a molded component of each of the leg slider joints 122 is free to glide along the vertical, square-shaped outer shaft portion 112 as is clearly shown in FIGS. 1–3. The leg slider joint 122 functions (a) to erect or expand the X-shaped truss pair of link members 156 of the upper support structure 104 when the leg slider joint 122 is in the raised position (see FIG. 1), and (b) to collapse the X-shaped truss pair of link members 156 of the upper support structure 104 when the leg slider joint 122 is in the lowered position (see FIGS. 3 and 22). Thus, the leg slider joint 122 cooperates with the upper support structure 104. Likewise, the leg slider joint 122 also cooperates with the superstructure 106 for supporting the plurality of canopy support arms 178 as will be described hereinbelow. These functions are accomplished by a plurality of three brackets molded to the main body 182 of the leg slider joint 122.

Each of the leg slider joints 122 includes a first bracket 184, a second bracket 186, and a third bracket 188 as is shown in FIG. 12. The first bracket 184 and the second bracket 186 are orthogonal to one another, i.e., generally formed at right angles. The first bracket 184 of the leg slider joint 122 is connected to a first of a plurality of link members 190 of the truss pair of link members 156 with a fastener 192 such as, for example, a rivet. The first of the plurality of link members 190 is likewise connected to the second bracket 186 of the leg slider joint 122 mounted on the outer shaft portion 112 of the adjacent telescopic corner leg 108 as shown in FIGS. 2 and 3. The second bracket 186 of the leg slider joint 122 shown in FIG. 12 is connected to a first of a plurality of link members 194 of the truss pair of link members 156 with a duplicate fastener 196. The first of the plurality of link members 194 is likewise connected to the first bracket 184 of the leg slider joint 122 mounted on the outer shaft portion 112 of the adjacent telescopic corner leg 108 best shown in FIG. 1. Likewise, each first bracket 184 of the leg slider joint 122 of a telescopic corner leg 108 is connected to the second bracket 186 of the adjacent leg slider joint 122 of the adjacent telescopic corner leg 108. In this manner, each leg slider joint 122 of each telescopic corner leg 108 is connected to the adjacent leg slider joint 122 of the adjacent telescopic corner leg 108 via a link member of the truss pair of link members 156.

Figure 10:
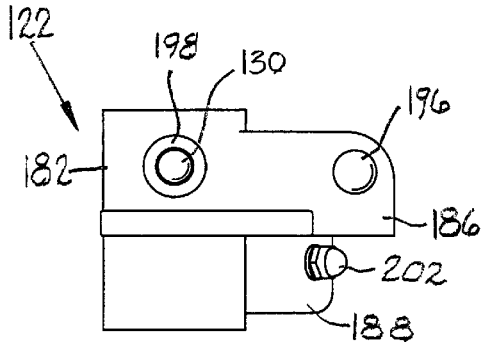
FIG. 10 is a side elevation of one of the four leg slider joints of the collapsible frame of FIG. 1.

It is noted that FIG. 10 illustrates a side elevation view of one of the plurality of leg slider joints 122 specifically showing the second bracket 186 and the third bracket 188. The main body 182 of each of the leg slider joints 122 includes a penetration 198 for receiving the bump or rise 130 of the V-shaped, spring-loaded pushbutton 118 shown in FIG. 14. Thus, as the leg slider joint 122 is moved from the bottom to the top of the outer shaft portion 112 of the telescopic corner leg 108, the main body 182 depresses the bump or rise 130 of the pushbutton 118. When the penetration 198 formed in the main body 182 aligns with the penetration 116 formed in the outer shaft portion 112, the bump or rise 130 of the pushbutton 118 pops through the penetration 198 to lock the leg slider joint 122 in position. Depressing the bump or rise 130 releases the leg slider joint 122 and enables the leg slider joint 122 to be released and moved downward on the outer shaft portion 112.

The third bracket 188 is also shown in FIGS. 10 and 12 and is employed to connect each of the leg slider joints 122 mounted on each of the outer shaft portions 112 to the superstructure 106. In particular, the third bracket 188 of each of the leg slider joints 122 is connected to a corresponding one of a plurality of angular support arms 200 via a threaded fastener 202 as shown in FIGS. 10 and 12. The terminal end of each of the plurality of angular support arms 200 is connected to the corresponding canopy support arm 178 by a plastic grip 204 as shown in FIGS. 1–3 and 20. The angular support arms 202 are clearly shown in FIGS. 1–3 and 10 and are intended to support the corresponding canopy support arms 178 when the leg slider joint 122 is in the raised position. When the leg slider joint 122 is released from the raised position as shown in FIG. 3, the angular support arms 200 assist in collapsing the corresponding canopy support arms 178 as described in more detail hereinbelow.

The plurality of top corner joints 154 and the leg slider joints 122 have now been described. Referring to the side elevation view of FIG. 2, two adjacent telescopic corner legs 108 are shown in the raised position, i.e., the inner shaft portions 110 are shown extended. Further, the leg slider joints 122 are locked in the upper position. It can be seen that the truss pair of link members 156 is comprised of the first of the plurality of link members 168 and the first of the plurality of link members 190 (showing only one of the four sides of the collapsible frame 100 that utilize link members 168 and 190). The link members 168 extend between the first bracket 162 of the top corner joint 154 (right side of FIG. 2) and the second bracket 164 of the adjacent top corner joint 154 (left side of FIG. 2). Likewise, the link members 190 extend between the first bracket 184 of the leg slider joint 122 (right side of FIG. 2) and the second bracket 186 of the adjacent leg slider joint 122 (left side of FIG. 2).

Each of the link members 168 and 190 of the truss pair of link members 156 include a fitting 206 that enable each of the link members 168 and 190 to be formed in pairs. Likewise, each intersection of a link member 168 with a link member 190 (for example) also includes an identical fitting 206. The fitting 206 is a combination of a permanent fastener such as a rivet with a plastic standoff (not shown) positioned between the two link members being connected together. The construction of the fitting 206 enables each of the link members 168 or 190 to rotate with respect to the other link member to which is it attached.

Consequently, when one of the telescopic corner legs 108 is moved with respect to the other telescopic corner legs 108 as shown in FIGS. 2 and 3, the truss pair of link members 156 provides a scissors connector movement. FIGS. 1 and 2 show the leg slider joint 122 in the locked position where the truss pair of link members 156 provides stability to all four sides of the collapsible frame 100. However, FIG. 3 shows that when the leg slider joint 122 is released by pressing the bump or rise 130 of pushbutton 118, the link member 190 is affected by the movement of the leg slider joint 122. This action is evident in FIG. 3 by the change of position of the fittings 206 in both link members 168 and 190. Therefore, it is the movement of the leg slider joint 122 along the outer shaft portion 112 of each telescopic corner leg 108 that causes a change in position of the truss pair of link members 156. The change in position of the truss pair of link members 156 either provides stability to the collapsible frame 100 or initiates the collapse thereof depending on the direction of movement of the leg slider joint 122 along the outer shaft portion 112.

The superstructure 106 of the collapsible frame 100 is shown in FIGS. 1–3 and 20–21 and generally includes the plurality of four canopy support arms 178, a plurality of four flexible connectors 208 formed within each of the canopy support arms 178, a top joint connector 210 including a four-hinge junction 212, and the plurality of four angular support arms 200. The superstructure 106 of the present invention serves to support the canopy 148, or tent fabric, shade awning, screen room or other cover enclosure fabric discussed in more detail in FIGS. 15–19.

Each of the four canopy support arms 178 is circular and is comprised of an outer portion 214 and an inner portion 216 best shown in FIGS. 3 and 4. FIG. 3 illustrates a situation in which the leg slider joint 122 is not secured in the locked position. Thus, each of the canopy support arms 178 is shown separated into the outer portion 214 which fits over the end of the inner portion 216 at a lip 224. With this arrangement, the inner portion 216 can experience a limited separation from the outer portion 214 under pressure. Running a partial length through the interior of the outer portion 214 and the inner portion 216 of each of the canopy support arms 178 is a heavy elastic cord 220 as is shown in FIG. 4. The length of the elastic cord 220 includes a short length of link chain 222 as shown in FIG. 4 wherein the elastic cord 220 is connected to the link chain 222 in any suitable manner such as, for example, by tying. The opposite ends 224 of the elastic cord 220 are secured within the outer portion 214 and the inner portion 216 of each of the canopy support arms 178 as follows. Attached (as by tying) to the opposite ends 224 of the elastic cord 220 is a anchor hook 226 as is shown in FIG. 4. The anchor hook 226 is easily inserted into the circular cross-section of the aluminum canopy support arm 178. However, upon attempting to remove the anchor hook 226, it digs into the aluminum sidewall of the canopy support arm 178. This construction securely attaches the elastic cord 220 to the interior of each of the canopy support arms 178.

The function of the elastic cord 220 is to urge the mating of the outer portion 214 with the inner portion 216 of the canopy support arm 178 while simultaneously enabling them to be partially separated for facilitating the lowering of the collapsible frame 100. Although the elastic cord 220 is very robust, the edges of the outer portion 214 and the inner portion 216 of the canopy support arm 178 will wear the elastic cord 220. Therefore, the function of the link chain 222 is prevent the wear and chaffing of the elastic cord 220 during use. This design facilitates the collapsing of the superstructure 106 but also enables the outer portion 214 to be only partially separated from the inner portion 216 under pressure.

Another suitable flexible connector 208 is shown in FIGS. 5 and 6 and can, if desired, completely replace the elastic cord 220, link chain 222 and anchor hook 226 just described.

The second suitable flexible connector 208 can be approximately centrally positioned along each of the four canopy support arms 178 and can be realized as a mid-span hinge 228. Each of the four canopy support arms 178 is circular and comprised of a lightweight material such as, for example, aluminum. The length of each of the four canopy support arms 178 is interrupted approximately at the center of the span thereof forming two opposing, open-ended mid-span terminal ends 230 and 232 as shown in FIG. 6. Extending outward from each of the open-ended terminal ends 230 and 232 is a pair of connectors 234 and 236 having penetrations formed therethrough. Connectors 234 and 236 may be comprised of plastic having an outer surface which exhibits a low coefficient of friction such as Teflon.

Positioned between the pair of connectors 234 and 236 is a pair of parallel positioned plates 238 and 240 swivelly attached to the corresponding connectors 234 and 236, respectively, of each of the canopy support arms 178. The parallel positioned plates 238 and 240 are attached to each of the corresponding connectors 234 and 236 as by, for example, use of a pair of rivets 242 through the penetrations formed in the connectors 234 and 236 as is shown in FIG. 6. Mounted over each of the canopy support arms 178 and the mid-span hinge 228 is a sliding sleeve 244 shown in FIGS. 5 and 6. The sliding sleeve 244 is cylindrical in shape and can be comprised of aluminum or a high strength plastic material such as polyvinylchloride (PVC). Further, the sliding sleeve 244 can have an inner surface (not shown) coated with a low friction material such as Teflon to minimize resistance to sliding.

In the view of FIG. 6, the sliding sleeve 244 is disengaged and the mid-span hinge 228 is exposed and capable of swivelling. Under these conditions, the mid-span hinge 228 is flexibly collapsible and cooperates with the corresponding canopy support arm 178 and the corresponding leg slider joint 122 to enable the collapsible frame 100 to collapse into the reduced size posture as clearly shown in FIG. 22. Located on the surface of the canopy support arm 178 is a first mechanical stop 246 as shown in FIG. 6. The first mechanical stop 246 serves to limit the travel of the sliding sleeve 244 away from the mid-span hinge 228. When the sliding sleeve 244 is engaged and thus positioned directly over the mid-span hinge 228 as shown in FIG. 5, the mid-span hinge 228 becomes rigidly inflexible and provides structural support to the corresponding canopy support arm 178. A second mechanical stop 248 is positioned on the side opposite to the first mechanical stop 246 and serves to limit the travel of the sliding sleeve 244 in the opposite direction. It is noted that although the mid-span hinge 228 utilizes an interior hinge and an externally positioned sliding sleeve 244, other types of mid-span hinges that utilize an internal sliding device and an external hinge are also intended to be within the scope of the present invention.

Figure 21:
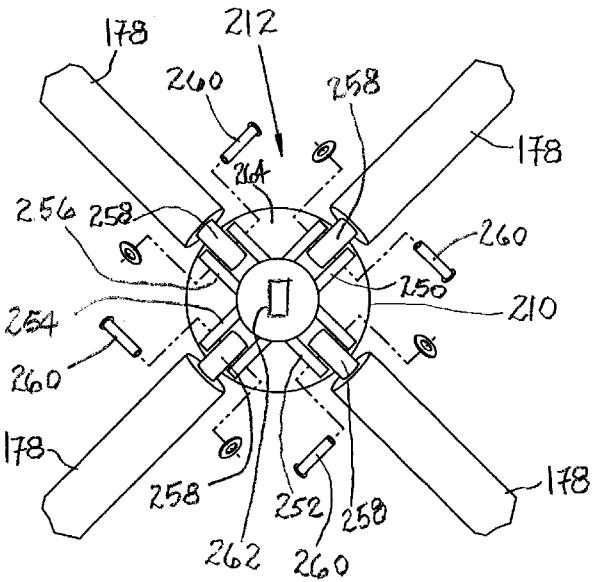
FIG. 21 is a bottom planar view of the superstructure of the collapsible frame of FIG. 1 showing the lower disk surface of the top joint connector including the four canopy support arms extending outward.

The top joint connector 210 includes the four-hinge junction 212 as shown in FIGS. 1–3 and FIG. 21. The four-hinge junction 212 is comprised of high strength plastic and includes a structure comprising four separate identical, plastic hinges 250, 252, 254 and 256 each orthogonal to the others as is shown in FIG. 21. Each of the four hinges 250, 252, 254 and 256 of the four-hinge junction 212 cooperates and receives one of a plurality of four terminal ends 258 of the corresponding canopy support arm 178. The terminal ends 258 are also comprised of plastic and are connected within the ends of the round aluminum canopy support arms 178 as by swaging. As with the previous construction, a mechanical fastener 260 (such as a rivet, cotter pin, or the like) is utilized to connect each of the terminal ends 258 of the canopy support arms 178 to the corresponding hinge 250, 252, 254 or 256 of the four hinge junction 212. After the connections are complete, each of the hinges 250, 252, 254 and 256 are securely fastened to the four-way junction 212. The construction stabilizes the entire superstructure 106 and adds strength to the collapsible frame 100. Mounted within the four-hinge junction 212 is an eyelet 262 as is shown in FIGS. 2 and 21. The eyelet 262 serves as a convenient point to hang articles that are useful inside of the collapsible frame 100 such as a lantern (not shown). Mounted over the top of the four-hinge junction 212 is a flat disk 264 which serves to improve the cosmetic appearance of the top joint connector 210 by hiding the four-hinge junction 212 as is shown in FIGS. 1–3 and 20–22.

The plurality of angular support arms 200 are connected between the third bracket 188 of the leg slider joint 122 and a corresponding one of the canopy support arms 178 as is best shown in FIGS. 2 and 12. The plurality of plastic grips 204 are employed for connecting the angular support arm 200 to the corresponding one of the canopy support arms 178. A plastic hinge 266 is formed as part of the plastic grip 204 as is shown in FIG. 2. Each of the angular support arms 200 connects to a penetration formed through the plastic hinge 266 with a fastener such as a rivet. The junction between the angular support arm 200 and the plastic hinge 266 pivots so that the position of the angular support arm 200 changes as the leg slider joint 122 translates along the outer shaft portion 112 of each of the telescopic corner legs 108.

Figure 22:
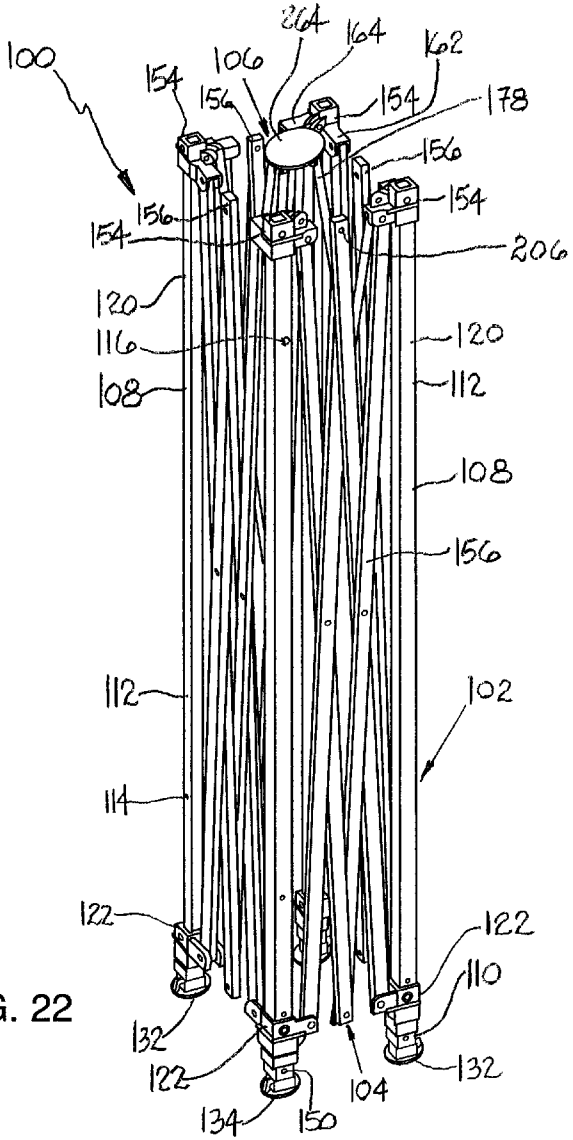
FIG. 22 is a perspective view of the collapsible frame of FIG. 1 shown in the collapsed position in preparation of insertion into a carrying case.

FIG. 22 represents the collapsible frame 100 in the collapsed state which is also the storage position. The base portion 102 particularly the telescopic corner legs 108 are shown standing vertically and the inner shaft portion 110 is shown inserted inside of the outer shaft portion 112 so that the outer shaft portion 112 is resting against the corresponding stop stud 150. Likewise, the top corner joints 154 are positioned at the top of each of the telescopic corner legs 108. The upper support structure 104 is comprised of the leg slider joints 122 and the truss pair of link members 156. The leg slider joints 122 are shown resting at the bottom of the outer shaft portions 112 of the corresponding telescopic corner legs 108. Further, the truss pair of link members 156 (i.e., the scissors connector) is shown positioned between the telescopic corner legs 108. Finally, the superstructure 106 comprised of the plurality of canopy support arms 178 including the corresponding flexible connectors 208, angular support arms 200, top joint connector 210 and the four hinge junction 212 is shown surrounded by the telescopic corner legs 108 and truss pair of link members 156. The flat disk 264 mounted over the top of the four hinge junction 212 is shown extending out from the top of the collapsible frame 100.

It is to be emphasized that the collapsible frame 100 is constructed as a unitary structure since all components remain connected at all times. Thus, in the collapsed view of FIG. 22, all components are connected and the entire unit can be picked-up and carried away. There are no loose, unattached elements or components of structure in the collapsible frame 100 of the present invention. Thus, the collapsible frame 100 is raised and lowered, not assembled or disassembled. The collapsible frame 100 is shown in the lowered (storage) position in FIG. 22.

To raise the collapsible frame 100 from the position shown in FIG. 22, each of the telescopic corner legs 108 are separated to provide a wider base. This causes the truss pair of link members 156 to begin to expand into a scissors formation. The inner shaft portion 110 is extended outward of the outer shaft portion 112 for adjusting the length of the telescopic corner legs 108. The leg slider joints 122 are then raised upward along the outer shaft portions 112. The raising of the leg slider joints 122 causes the angular support arms 200 to begin to raise the plurality of canopy support arms 178 for erecting the superstructure 106. Once the leg slider joints 122 are locked into position by the action of the V-shaped, spring-loaded pushbutton 118, the canopy support arms 178 are completely raised. The telescopic corner legs 108 are then adjusted to maximize the width of the base and ground stakes (not shown) can be driven into the ground through the penetrations 136 formed in the base foot 132. The canopy 148 can then be applied and secured to the erected collapsible frame 100. The procedure is then reversed to lower the frame 100 to the collapsed position shown in FIG. 22.

Figure 15:
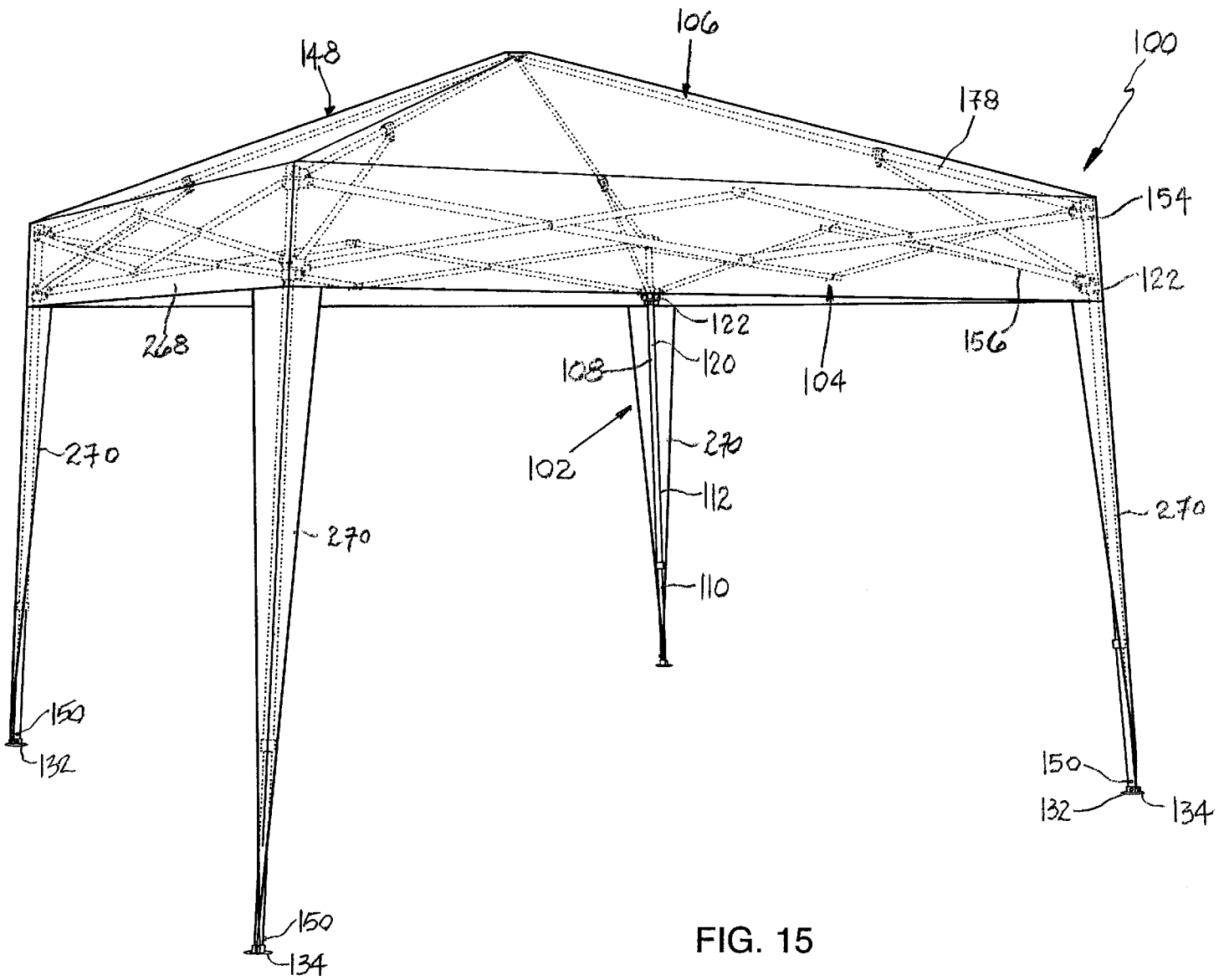
FIG. 15 is a perspective view of the collapsible frame of FIG. 1 showing a canopy positioned thereon with the collapsible frame shown in phantom.
Figure 16:
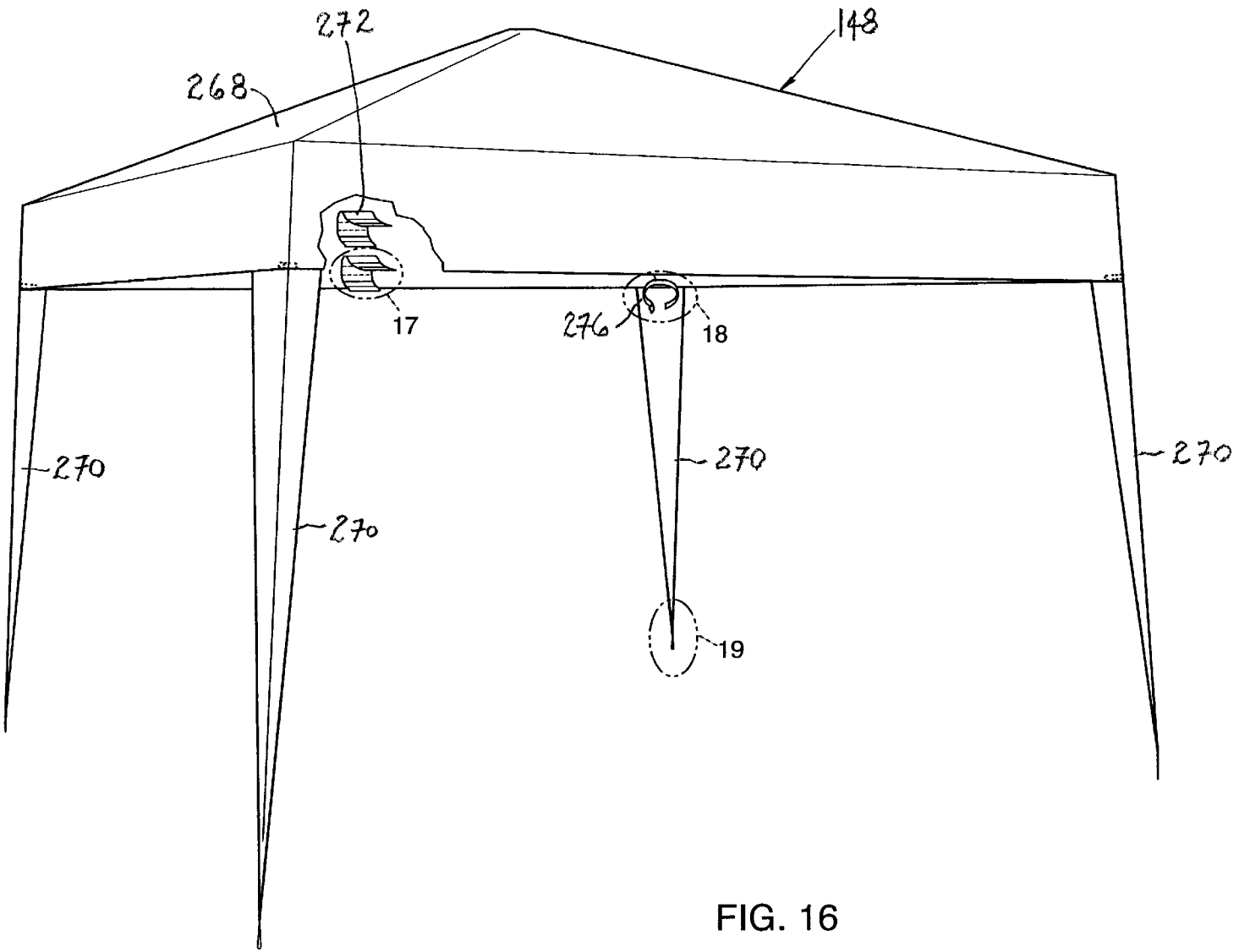
FIG. 16 is a perspective view of the collapsible frame of FIG. 1 showing the canopy positioned thereon including three methods of attaching the canopy to the collapsible frame including hook and loop fasteners shown in a cutaway.

The canopy 148 and the attachment means is shown in FIGS. 15–19 and will now be discussed. The canopy 148 is shown installed on the collapsible frame 100 in FIG. 15. The canopy 148 includes a body 268 having four corners and a generally rectangular shape. The canopy body 268 can be comprised of a lightweight material such as nylon but any other suitable material can be utilized. The body 268 is cut and formed so that it fits the collapsible frame 100 as shown in FIG. 15. The canopy 148 also includes a plurality of legs 270 attached to the body 268 as shown in FIGS. 15 and 16. The plurality of legs 270 serve to wrap about and cover the telescopic corner legs 108 of the collapsible frame 100 as shown in FIG. 15.

Figure 17:
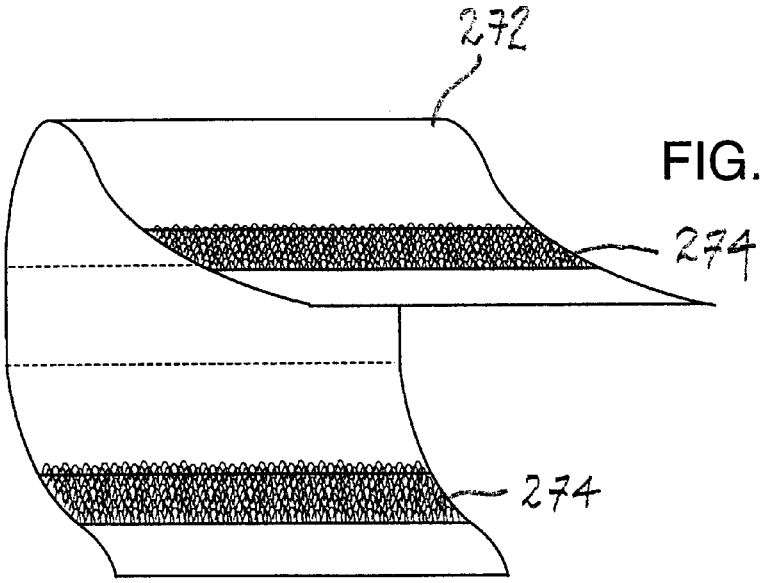
FIG. 17 is a perspective view of a first hook and loop fastener wrap sewn into the fabric of the canopy for attaching the canopy to the collapsible frame.
Figure 18:
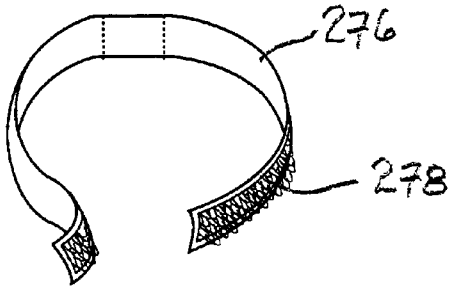
FIG. 18 is a perspective view of a second hook and loop fastener wrap sewn into the fabric of the canopy for attaching the canopy to the telescopic corner legs.

The canopy 148 is removably attached to the collapsible frame 100 at several locations as shown in FIG. 16. The first means of attachment is shown in FIG. 17 and includes a wide wraparound strap 272 sewn at several locations along the border of the canopy body 268 as shown in FIG. 16. The wide wraparound strap 272 includes a hook and loop fastener 274 and is employed to attach the canopy body 268 to, for example, a section of the truss pair of link members 156 shown in phantom in FIG. 15. A second means for attaching the canopy body 268 to the collapsible frame 100 is shown in FIG. 18. The second means of attachment includes a leg strap 276 sewn at the interface of each of the plurality of legs 270 with the canopy body 268 as shown in FIG. 16. The leg strap 276 also includes a hook and loop fastener 278 as is shown in FIG. 18 and is employed to attach the canopy body 268 about, for example, the telescopic corner legs 108.

Figure 19:
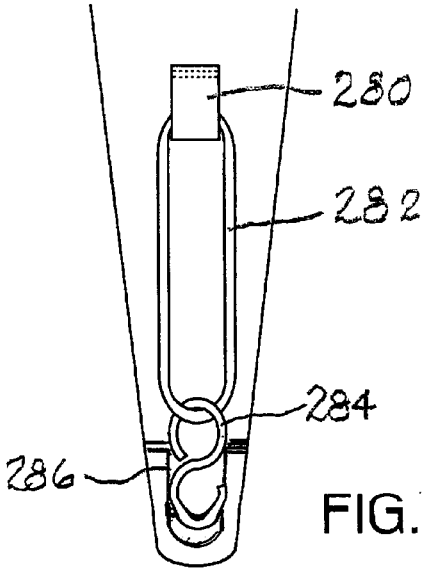
FIG. 19 is a front elevation of the bottom of one of the four legs of the canopy positioned over the collapsible frame of FIG. 1 showing the method of attaching each of the legs of the canopy to one of the four telescopic corner legs.
Figure 20:
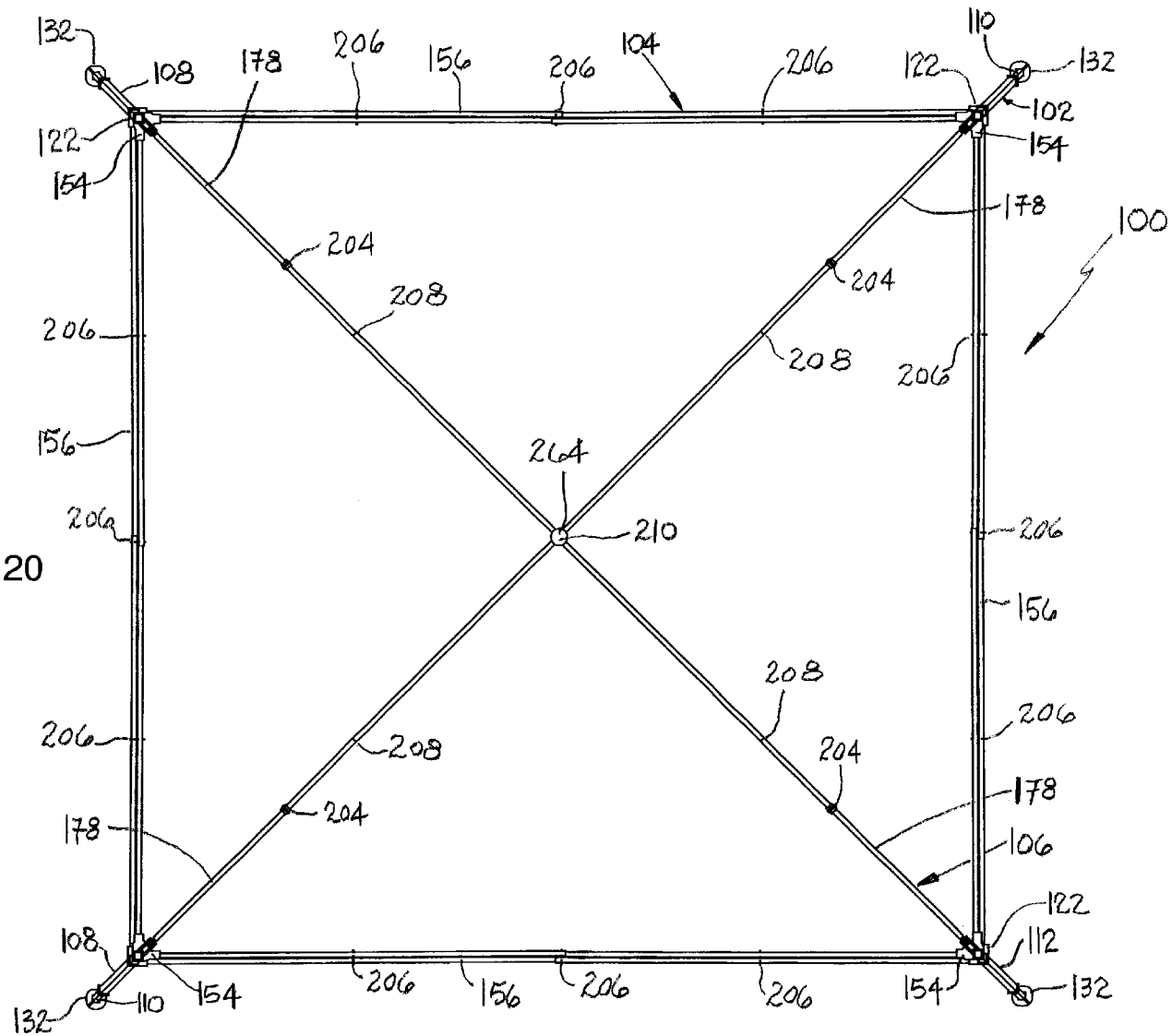
FIG. 20 is a top planar view of the collapsible frame of FIG. 1 showing the four telescopic corner legs, four top corner joints, four X-shaped truss pairs of link members, four canopy support arms including the associated flexible connectors, and the upper disk surface of a top joint connector.

The third means of attaching the canopy body 268 to the collapsible frame 100 is for attaching the plurality of legs 270 to the base foot 132 of the collapsible frame 100 as shown in FIG. 19. At the bottom of each of the plurality of legs 270 is a pair of attachment means including a first web loop 280 sewn to the inside of each of the plurality of legs 270. Connected to the first web loop 280 is an elastic cord 282 having a hook 284 attached thereto. Also, sewn to the very bottom of each of the plurality of legs 270 is a second web loop 286 as is shown in FIG. 19. Once the canopy body 268 is applied to the collapsible frame 100, the hook 284 attached to each of the plurality of legs 270 is passed through the penetration 144 of the first extension 142 of the base foot 132 as shown in FIG. 13. Further, the second web loop 286 is passed under the second hook extension 146 of the base foot 132 also shown in FIG. 13. In this manner, each of the plurality of legs 270 is securely attached to the corresponding telescopic corner leg 108.

The collapsible frame 100 of the present invention is generally comprised of lightweight metal such as aluminum. For example, the telescopic corner legs 108 including the inner shaft portion 110 and the outer shaft portion 112 and the truss pair of link members 156 are each comprised of rectangular-shaped aluminum. The plurality of canopy support arms 178 and the corresponding angular support arms 200 are each comprised of aluminum of a circular cross-section. However, the top corner joints 154, leg slider joints 122, each base foot 132, plastic grips 204, top joint connector 210, four hinge junction 212, and the flat disk 264 are each fabricated from high strength plastic. However, it should be understood that other suitable materials can be utilized and are deemed to be within the scope of the invention.

The present invention provides novel advantages over other collapsible frame devices known in the art. The main advantage of the collapsible frame 100 is that it exhibits a unitary construction, i.e., the collapsible frame 100 is a unitary structure since all component parts are constantly connected together. Each of the telescopic corner legs 108 are connected to the X-shaped, truss pair of link members 156 via the top corner joints 154 and the leg slider joints 122 each of which are attached to the telescopic corner legs 108. Further, the superstructure 106 is connected to both the top corner joints 154 and the leg slider joints 122. The canopy support arms 178 of the superstructure 106 each include a flexible connector 208 so that the operation of the leg slider joint 122 causes the entire frame structure to raise or lower in unison depending upon the direction of movement of the leg slider joint 122. Further, the collapsible frame 100 of the present invention includes a robust lightweight design of aluminum and plastic which simplifies transportation of the frame 100. Further, the collapsible frame 100 is raised and lowered quickly and easily since tools are not required. When lowered, the collapsible frame 100 is transported and stored in a convenient carrying case (not shown).

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention. Accordingly,

What is claimed is:

1. A collapsible frame comprising:

a plurality of telescopic legs for providing vertical structural support each having a stop stud attached to the inner shaft of said telescopic leg;

a plurality of top corner joints with each of said corner joints fixedly mounted upon a top end of a corresponding one of said telescopic legs;

a leg slider joint adjustably mounted upon each of said telescopic legs for sliding along a corresponding one of said telescopic legs;

a trust pair of link members mounted to a pair of said top corner joints and to a corresponding pair of said leg slider joints mounted on each adjacent pair of said telescopic legs for providing a scissors connector; and a plurality of canopy support arms each including a flexible connector and each fixedly connected to a corresponding one of said top corner joints and to a corresponding one of said leg slider joints for raising and lowering said collapsible frame as a stable unitary structure.

2. The collapsible frame of claim 1 wherein said frame is comprised of aluminum.

3. The collapsible frame of claim 1 wherein said frame is rectangular in shape.

4. The collapsible frame of claim 1 wherein each of said telescopic legs is rectangular in shape.

5. The collapsible frame of claim 1 wherein a bottom end of an inner shaft of each of said telescopic legs further comprises a mechanical stop for limiting the travel of an outer shaft of each of said telescopic legs.

6. The collapsible frame of claim 1 wherein each of said telescopic legs includes a base foot for stabilizing said frame.

7. The collapsible frame of claim 6 wherein said base foot further includes a plurality of first penetrations for anchoring a frame canopy thereto.

8. The collapsible frame of claim 1 wherein each of said leg slider joints is rectangular in shape.

9. The collapsible frame of claim 1 wherein each of said leg slider joints is fixedly attached to a corresponding canopy support arm by one of a plurality of angular support arms.

10. The collapsible frame of claim 1 wherein said flexible connector included within each of said canopy support arms comprises an elastic connector.

11. The collapsible frame of claim 1 wherein said flexible connector included within each of said canopy support arms comprises a hinge having a sliding sleeve.

12. The collapsible frame of claim 1 further including a top joint connector for connecting together a plurality of upward facing ends of said canopy support arms.

13. The collapsible frame of claim 12 wherein said top joint connector further includes a multiple-hinge junction for connecting together said upward facing ends of said canopy support arms.

14. The collapsible frame of claim 13 wherein said top joint connector further includes an upper disk surface for covering said multi-hinge junction.

15. The collapsible frame of claim 1 wherein each of said telescopic legs further includes a first V-shaped, spring-loaded push button mounted therein for locking in position a corresponding canopy support arm.

16. The collapsible frame of claim 1 wherein each of said telescopic legs further includes a second V-shaped, spring-loaded push button mounted therein for adjusting the length of a corresponding one of said telescopic legs.

17. A collapsible frame comprising:

a plurality of telescopic legs for providing vertical structural support;

a plurality of top corner joints with each of said corner joints fixedly mounted upon a top end of a corresponding one of said telescopic legs;

a leg slider joint adjustably mounted upon each of said telescopic legs for sliding along a corresponding one of said telescopic legs;

a truss pair of link members mounted to a pair of said top corner joints and to a corresponding pair of said leg slider joints mounted on each adjacent pair of said telescopic legs for providing a scissors connector; and a plurality of canopy support arms each including a flexible elastic connector within a link chain and each fixedly connected to a corresponding one of said top corner joints and to a corresponding one of said leg slider joints for raising and lowering said collapsible frame as a stable unitary structure.

18. A collapsible frame comprising;

a plurality of telescopic legs for providing vertical structural support each having a stop stud affixed to the inner shaft of said telescopic leg;

a plurality of top corner joints with each of said corner joints fixably mounted upon a top end of a corresponding one of said telescopic legs;

a leg slider joint adjustably mounted upon each of said telescopic legs for sliding along a corresponding one of said telescopic legs;

a trust pair of link members mounted to a pair of said top corner joints and to a corresponding pair of said leg slider joints mounted on each adjacent pair of said telescopic legs for providing a scissors connector and a plurality of canopy support arms each including a flexible hinge connector and each fixably connected to an corresponding one of said top corner joints and to a corresponding one of said leg slider joints for rasing a lowering said collapsible frame a stable and unitary structure.

19. The collapsible frame of claim 18 wherein said flexible hinge connector further includes a sliding sleeve.

* * * * *